US007559504B2

(12) United States Patent
Yang et al.

(10) Patent No.: US 7,559,504 B2
(45) Date of Patent: Jul. 14, 2009

(54) HOLDER FOR THIN-PLY ROLLS WHICH FACILITATES TEARING OF SECTIONS

(75) Inventors: Frank Yang, Rancho Palos Verdes, CA (US); Ian Fettes, Newport Beach, CA (US)

(73) Assignee: Simplehuman LLC, Torrance, CA (US)

( * ) Notice: Subject to any disclaimer, the term of this patent is extended or adjusted under 35 U.S.C. 154(b) by 137 days.

(21) Appl. No.: 11/698,787

(22) Filed: Jan. 25, 2007

(65) Prior Publication Data

US 2007/0194168 A1 Aug. 23, 2007

Related U.S. Application Data

(63) Continuation-in-part of application No. 29/271,603, filed on Jan. 23, 2007, now Pat. No. Des. 555,954, and a continuation-in-part of application No. 29/260,509, filed on May 24, 2006, now Pat. No. Des. 548,504, and a continuation-in-part of application No. 11/251,460, filed on Oct. 14, 2005, now Pat. No. 7,401,749, which is a continuation-in-part of application No. 11/094,808, filed on Mar. 29, 2005, which is a continuation-in-part of application No. 29/223,227, filed on Feb. 9, 2005, now Pat. No. Des. 518,985.

(51) Int. Cl.
*B65H 16/04* (2006.01)

(52) U.S. Cl. ..... 242/597.7; 242/422.4

(58) Field of Classification Search ..... 242/597.7, 242/597.1, 597.3, 597.4, 422, 422.4, 422.5
See application file for complete search history.

(56) References Cited

U.S. PATENT DOCUMENTS 1,684,190 A * 9/1928 Moser ..... 242/597.3

(Continued)

FOREIGN PATENT DOCUMENTS

DE 3613988 9/1987

(Continued)

OTHER PUBLICATIONS

Website page, www.oxo.com, Grip & Rip Paper Towel Holder—Stainless Steel, OXO International.

(Continued)

*Primary Examiner*—William A Rivera
(74) *Attorney, Agent, or Firm*—Liu & Liu

(57) ABSTRACT

A thin-ply roll holder, for example, a paper towel holder facilitates tearing of paper towels from a continuous roll supported on the holder, and prevents excessive unraveling of the roll. A pressure bar pivots at a hinge on the base, and is spring biased towards the pole that supports the roll, such that leverage of the bias about a hinge increases as the pressure bar pivots towards the pole, but the bias decreases at a lower rate than the increase in the leverage. At the distal free end of the pole, a retaining tab is pivoted to flip from a first orientation in which the hollow core of the paper towel is permitted to be received by the pole, to a second orientation in which the paper towel is not permitted to be removed from the pole. The pole is structured as a frame structure comprising rod-shaped segments.

20 Claims, 11 Drawing Sheets

U.S. PATENT DOCUMENTS

| | | | | | |
|---|---|---|---|---|---|
| 1,713,277 | A | * | 5/1929 | Emanuel et al. | 242/597.2 |
| D155,897 | S | * | 11/1949 | Huntington | D6/523 |
| 3,326,489 | A | * | 6/1967 | Lessler | 242/597.3 |
| 3,370,805 | A | | 2/1968 | Barbee | |
| 3,829,034 | A | * | 8/1974 | Mickelson | 242/597.3 |
| 3,863,856 | A | * | 2/1975 | Conlon, Jr. | 242/597.3 |
| 3,937,411 | A | * | 2/1976 | Vogel et al. | 242/597.3 |
| 4,030,676 | A | | 6/1977 | Bardsley | |
| 4,487,376 | A | | 12/1984 | Compton | |
| 4,690,345 | A | | 9/1987 | Cotey | |
| 4,720,053 | A | | 1/1988 | Vance | |
| 4,738,385 | A | | 4/1988 | Bell | |
| D298,290 | S | | 11/1988 | Wilkerson | |
| D298,597 | S | | 11/1988 | Bell | |
| 5,135,179 | A | | 8/1992 | Morano | |
| 5,170,956 | A | | 12/1992 | McTaggart | |
| 5,645,247 | A | * | 7/1997 | Voigt | 242/597.3 |
| D398,466 | S | | 9/1998 | Odom | |
| 5,938,141 | A | | 8/1999 | Kanbar | |
| D432,826 | S | | 10/2000 | Shimbo et al. | |
| 6,302,348 | B1 | * | 10/2001 | Lillelund et al. | 242/422.5 |
| D450,962 | S | | 11/2001 | Hundley | |
| 6,467,717 | B1 | * | 10/2002 | Pedicano et al. | 242/422.5 |
| 6,478,246 | B2 | | 11/2002 | Fahringer | |
| D477,730 | S | | 7/2003 | Hoernig | |
| D486,333 | S | | 2/2004 | Hoernig | |
| D489,558 | S | | 5/2004 | Snell | |
| D499,916 | S | | 12/2004 | Yang et al. | |
| 6,832,739 | B1 | * | 12/2004 | Kraus | 242/422.5 |
| D520,278 | S | * | 5/2006 | Mariano et al. | D6/521 |
| D520,785 | S | * | 5/2006 | Joseph | D6/521 |
| D548,504 | S | * | 8/2007 | Yang et al. | D6/521 |
| 7,264,197 | B2 | * | 9/2007 | Yu | 242/597.7 |
| 2002/0070308 | A1 | | 6/2002 | Fahringer | |
| 2002/0130211 | A1 | * | 9/2002 | Kerr | 242/422.5 |
| 2003/0029961 | A1 | | 2/2003 | Hollinger | |
| 2004/0159738 | A1 | * | 8/2004 | Duncan et al. | 242/597.7 |
| 2007/0176043 | A1 | * | 8/2007 | Yu | 242/597.7 |
| 2007/0235581 | A1 | * | 10/2007 | Charochak | 242/597.1 |

FOREIGN PATENT DOCUMENTS

| | | |
|---|---|---|
| EP | 473247 | 3/1992 |

OTHER PUBLICATIONS

Website page, www.oxo.com, Grip & Rip Paper Towel Holder—White, OXO International.
Website page, www.cooking.speedera.net.
Website page, http://store.yahoo.com/organizeeverything1, Grip & Rip Paper Towel Holder by OXO—Stainless Steel Model.
Website page, http://store6.yimg.com/l/organizeeverything1.
Website page, http://store.yahoo.com/organizeeverything1, Grip & Rip Paper Towel Holder by OXO—White Model.
Website page, http://www.cooking.com, OXO Stainless Steel Paper Towel Holder.
Website page, wwww.oxo.com, Simply Tear Paper Towel Holder—Stainless Steel, OXO International.

* cited by examiner 140
143

100
142
60
136
130
141
138
134
139
135
120

HOLDER FOR THIN-PLY ROLLS WHICH FACILITATES TEARING OF SECTIONS

This application is a continuation-in-part of copending U.S. Design patent application No. 29/260,509 entitled "Flip Top Paper Towel Holder", filed May 24, 2006; this application is a continuation-in-part of copending U.S. Design patent application No. 29/260,509 entitled "Flip Top Paper Towel Holder", filed Jan. 23, 2007; and this application is also a continuation-in-part of copending U.S. patent application Ser. No. 11/251,460, entitled "Holder for Paper Towel Rolls With a Quick Release Retractable Handle", filed Oct. 14, 2005, which is a continuation-in-part of copending U.S. patent application Ser. No. 11/094,808 entitled "Holder for Paper Towel Rolls", filed Mar. 29, 2005, which is a continuation-in-part of co-pending U.S. Design application No. 29/223,227 entitled "Wall Mount Paper Towel Holder", filed Feb. 9, 2005, now U.S. Design Pat. No. D518,985, issued Apr. 18, 2006; these applications are being hereby incorporated by reference as if fully set forth herein.

FIELD OF INVENTION

The invention relates to holders for holding and dispensing thin-ply rolls, such as paper towel rolls.

BACKGROUND OF INVENTION

Thin-ply rolls such as paper towel rolls are commonly used for household cleaning tasks. Within the roll, paper towels are defined in a continuous roll, by perforations across the roll. Holders have been designed to securely support the paper towel rolls at convenient locations for dispensing to users. One type of paper towel holder supports the paper towel roll with its axis oriented horizontally with respect to end supports. Another type of paper towel holder supports the paper towel with its axis oriented vertically with respect to a base. In the past, horizontal paper towel holders are mounted to a vertical support surface (e.g., wall-mounted), and vertical paper towel holders are free-standing on its base. Because of the vertical orientation of the paper towel in a vertical holder, the paper towel roll has a tendency to unravel as the towel roll relaxes under its own weight. Further, some of the past designs do not provide user with an easy way of tearing a piece of towel from the roll without dragging and unrolling too much of the roll on the holder.

U.S. Pat. No. 4,030,676 describes a vertical paper towel holder with a pole extending vertically from a base. The vertical pole includes a fixed handle for users to grasp and lift the holder. An annular rim of uniform height is provided at the edge of the base. According to the patent disclosure, the annular rim facilitates detachment of individual towel segments from the roll. However, it has been found that such design has its limitations, and often do not work as well as disclosed.

The assignee of the present application filed several design and utility patent applications, including copending U.S. Design patent application No. 29/260,509 entitled "Flip Top Paper Towel Holder", filed May 24, 2006; this application is a continuation-in-part of copending U.S. Design patent application No. 29/260,509 entitled "Flip Top Paper Towel Holder", filed Jan. 23, 2007; and this application is also a continuation-in-part of copending U.S. patent application Ser. No. 11/251,460, entitled "Holder for Paper Towel Rolls With a Quick Release Retractable Handle", filed Oct. 14, 2005, which is a continuation-in-part of copending U.S. patent application Ser. No. 11/094,808 entitled "Holder for Paper Towel Rolls", filed Mar. 29, 2005, which is a continuation-in-part of co-pending U.S. Design application No. 29/223,227 entitled "Wall Mount Paper Towel Holder", filed Feb. 9, 2005, now U.S. Design Pat. No. D518,985, issued Apr. 18, 2006; these applications are being incorporated by reference as if fully set forth herein. These applications provides improvements to the prior art paper towel holders, by providing structural features to prevent excessive unraveling and/or facilitates detachment of individual towel segments from a paper towel roll.

The present invention provides other improvements over the prior art paper towel holders by providing a different holder structure.

SUMMARY

The present invention provides a novel thin-ply roll holder that facilitates tearing of thin-ply sheets from the roll, such as paper towels from a continuous roll of paper towels, supported on the holder, and prevents excessive unraveling of the roll.

In one aspect of the present invention, a thin-ply roll holder is provided with a pad that applies a biasing pressure (e.g., from a spring load) against the cylindrical body of, for example, a paper towel, to prevent excessive unraveling and facilitate tearing of a piece of the towel roll. In one embodiment of the present invention, the pole is cantilevered from a base (e.g., a free standing base), sized to be received in the hollow core of a paper towel roll. The support for the pad pivots at the base, and is spring biased towards the pole. In one embodiment, the pad is supported on an arm that is pivotably supported at the base. The arm is biased by a spring bias in an axial direction towards the pole, and wherein the spring bias is applied to a point on the pressure bar such that leverage of the spring bias about the hinge increases as the pressure bar pivots towards the pole. In a further embodiment, the spring bias is a spring tension bias, and wherein the spring tension decreases at a lower rate than the increase in the leverage.

In another aspect of the present invention, a tab is provided at a free end of the pole that supports the towel roll, which can be positioned with respect to the pole to securely retain the towel roll from accidental detachment from the pole. At the distal free end of the pole, a retaining tab is pivoted to flip from a first orientation in which the hollow core of the paper towel is permitted to be received by the pole, to a second orientation in which the paper towel is not permitted to be removed from the pole. In one embodiment, the retaining tab is supported to pivot with respect to the pole from an axial orientation to a radial orientation.

In another embodiment, the pole is structured as a frame structure instead of a cylindrical structure.

The thin-ply roll holder of the present invention provides an effective structure that prevents, for example, a roll of paper towels from excessive unraveling, and facilitates ease of tearing of paper towel pieces from the roll. The retaining tab securely retains a paper towel roll on the pole.

BRIEF DESCRIPTION OF DRAWINGS

For a fuller understanding of the nature and advantages of the invention, as well as the preferred mode of use, reference should be made to the following detailed description read in conjunction with the accompanying drawings. In the following drawings, like reference numerals designate like or similar parts throughout the drawings.

DETAILED DESCRIPTION OF DRAWINGS

The present description is of the best presently contemplated mode of carrying out the invention. This description is made for the purpose of illustrating the general principles of the invention and should not be taken in a limiting sense. The scope of the invention is best determined by reference to the appended claims.

This invention has been described herein in reference to various embodiments and drawings. It will be appreciated by those skilled in the art that variations and improvements may be accomplished in view of these teachings without deviating from the scope and spirit of the invention. By way of illustration, the present invention will be described in reference to paper towel rolls of the kind typically used in household kitchens, for example. Other types of rolls of thin-ply sheets may be used in connection with the present invention.

The paper towel roll generally has a tube shaped core that supports a continuous roll of paper towels. The width of the roll is larger than the diameter of a full roll of paper towels. Individual pieces of paper towels (e.g., rectangular shaped) are defined by perforations across the roll. The perforation defines lines of weakness in the roll, to facilitate tearing of the roll to separate the individual pieces of paper towels. Paper towel rolls of other shapes and sizes, with or without perforations, may be used with the present invention. As used herein, paper towel rolls includes paper rolls that may comprise absorbent or non-absorbent paper sheets (e.g., wrapping paper sheets).

Figure 1:
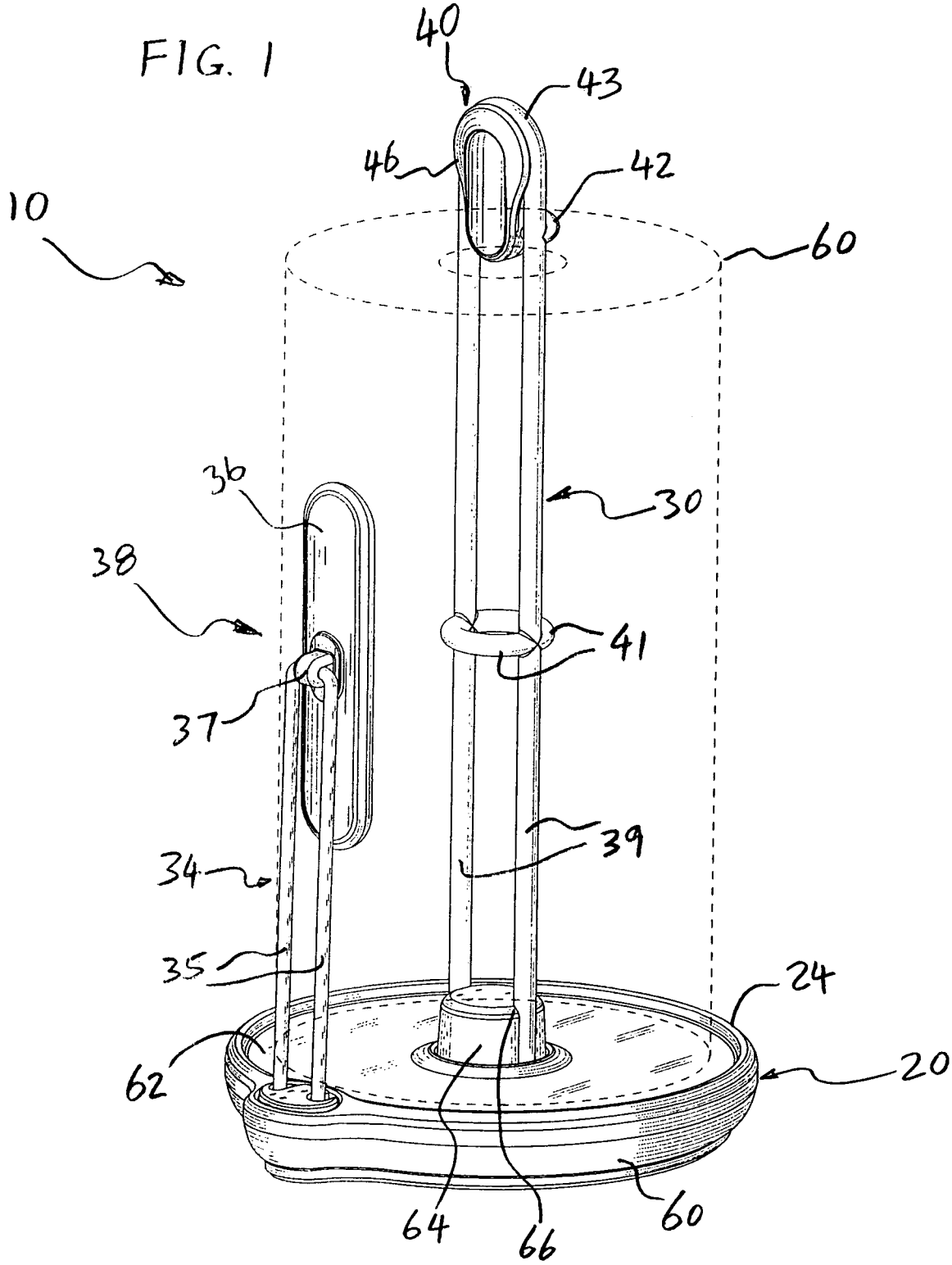
FIG. 1 is a perspective view of a thin-ply towel holder, e.g., a paper towel holder, in accordance with one embodiment of the present invention.
Figure 2:
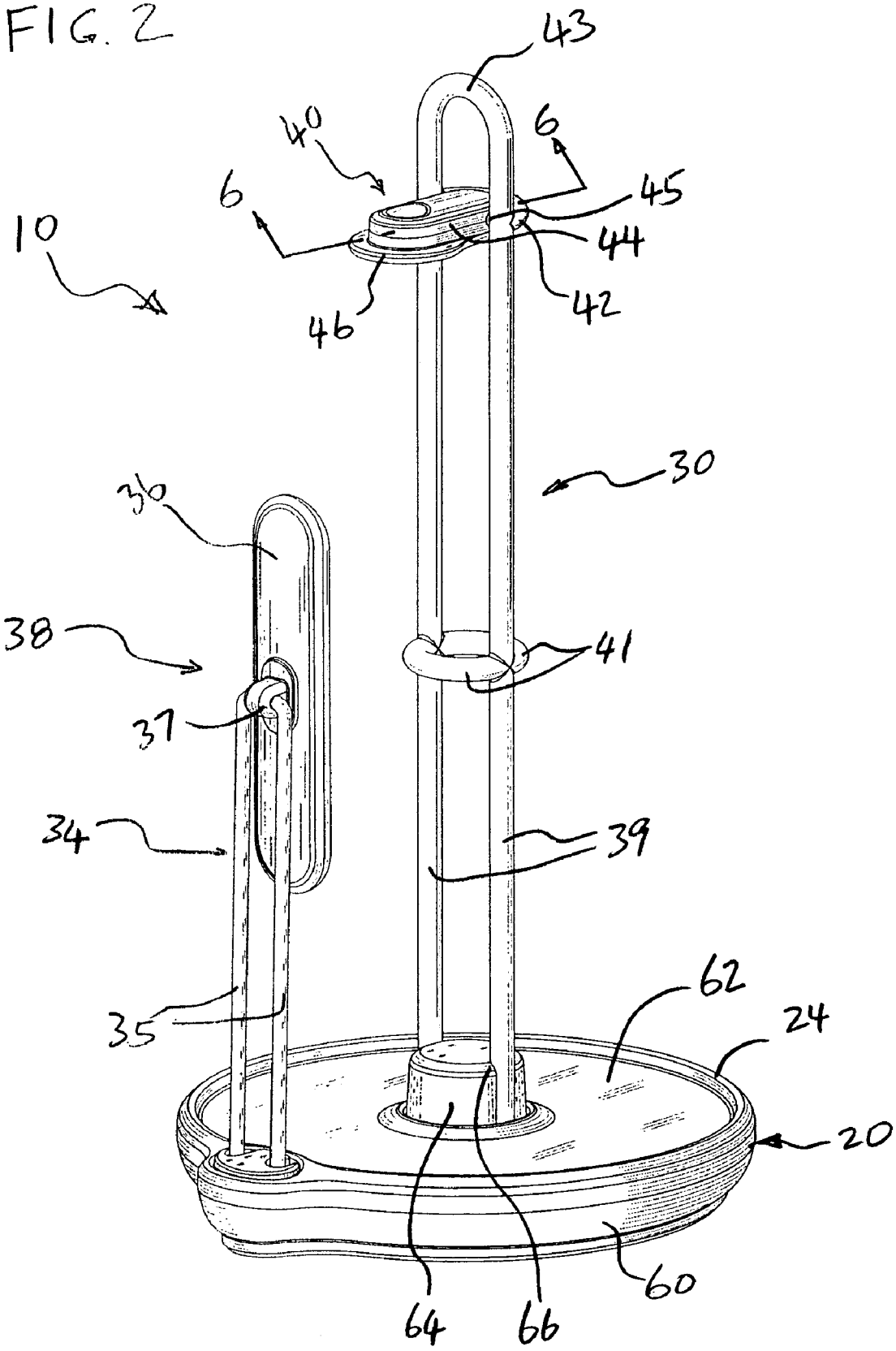
FIG. 2 is another perspective view of the embodiment of the paper towel holder of FIG. 1, without the paper towel roll in place.

In one embodiment of the present invention, the paper towel holder is of the type that is free-standing and portable, structured to support a paper towel roll with its axis oriented vertically. FIG. 1 is a perspective view of a paper towel holder 10, with the paper towel roll 60 indicated by dotted lines, in accordance with one embodiment of the present invention, supporting a roll 60 of paper towels. FIG. 2 is a perspective view showing the holder 10 standing alone without the paper towel roll. The holder 10 comprises primarily a pedestal or base 20, a pole 30 vertically supported by and extending from the base 20, a pressure bar 38 pivotally supported at the base 20, and a retaining tab 40 pivotally attached to near or at the proximity of the top distal end of the pole 30.

Figure 3:
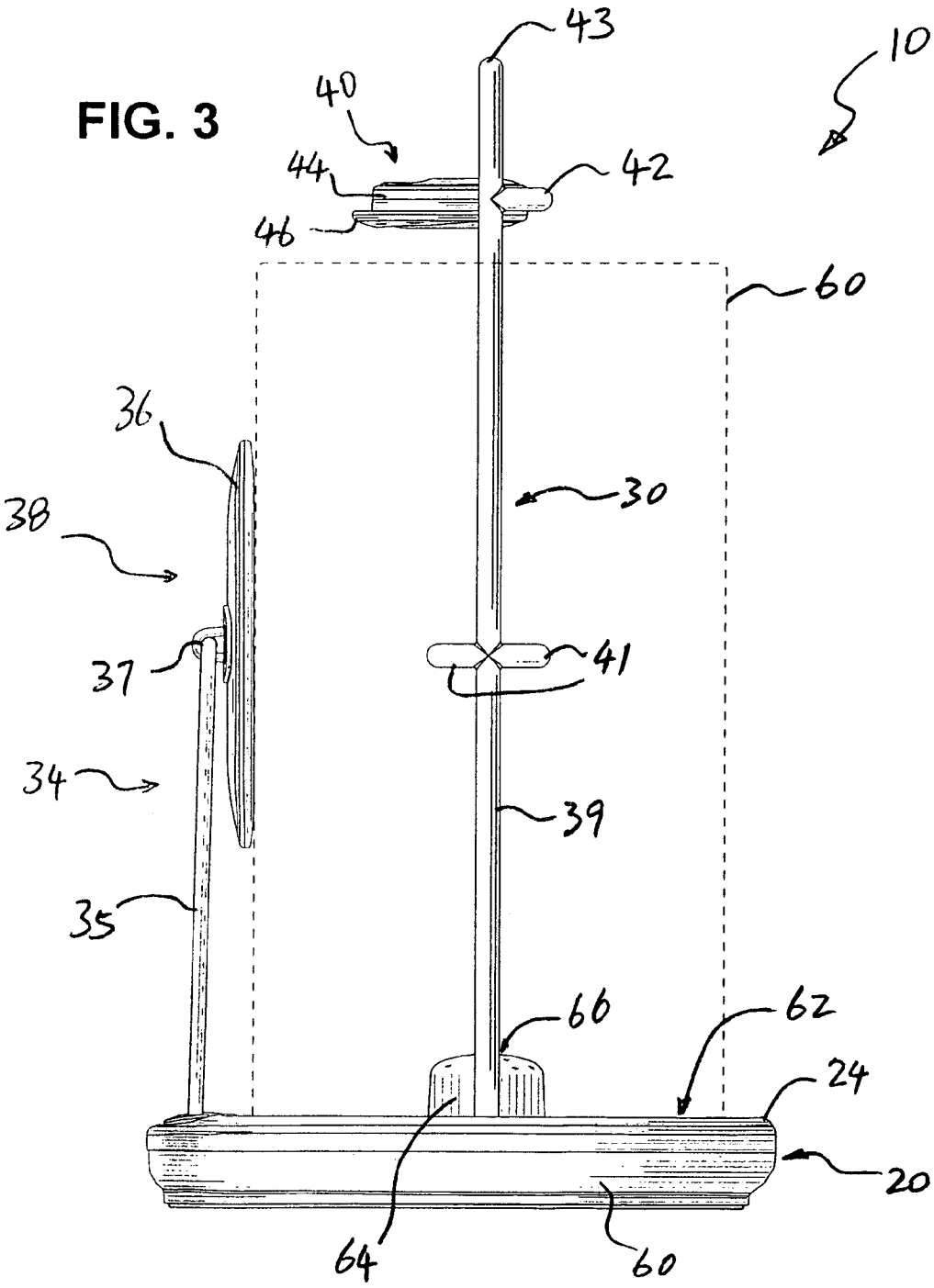
FIG. 3 is a side view of the embodiment of the paper towel holder of FIG. 1.

Referring also to FIG. 3, the pressure bar 38 has a contact surface that applies a biasing pressure towards the pole 30 (e.g., provided by a spring load applied at the pivot at the base 20), thereby pressing against the cylindrical body of the paper towel roll, to prevent excessive unraveling and facilitate tearing of a piece of the towel roll. In the illustrated embodiment, the pressure bar 38 includes a pad 36 pivotally attached at an end of an arm 34 that is pivotally supported at the rim of the base 20. The pressure bar 38 retains the loose end of the paper towel roll 60 to within the perimeter of the base 20, and facilitates tearing of a piece of towel from the roll. This prevents undesirable excessive unraveling of the paper towel roll and facilitates separation and dispensing of sections of paper towels, especially in a work environment such as a kitchen, in which one hand of the user may be occupied or unclean, while the other hand is the only hand available to tear off a section of paper towel.

Figure 5A:
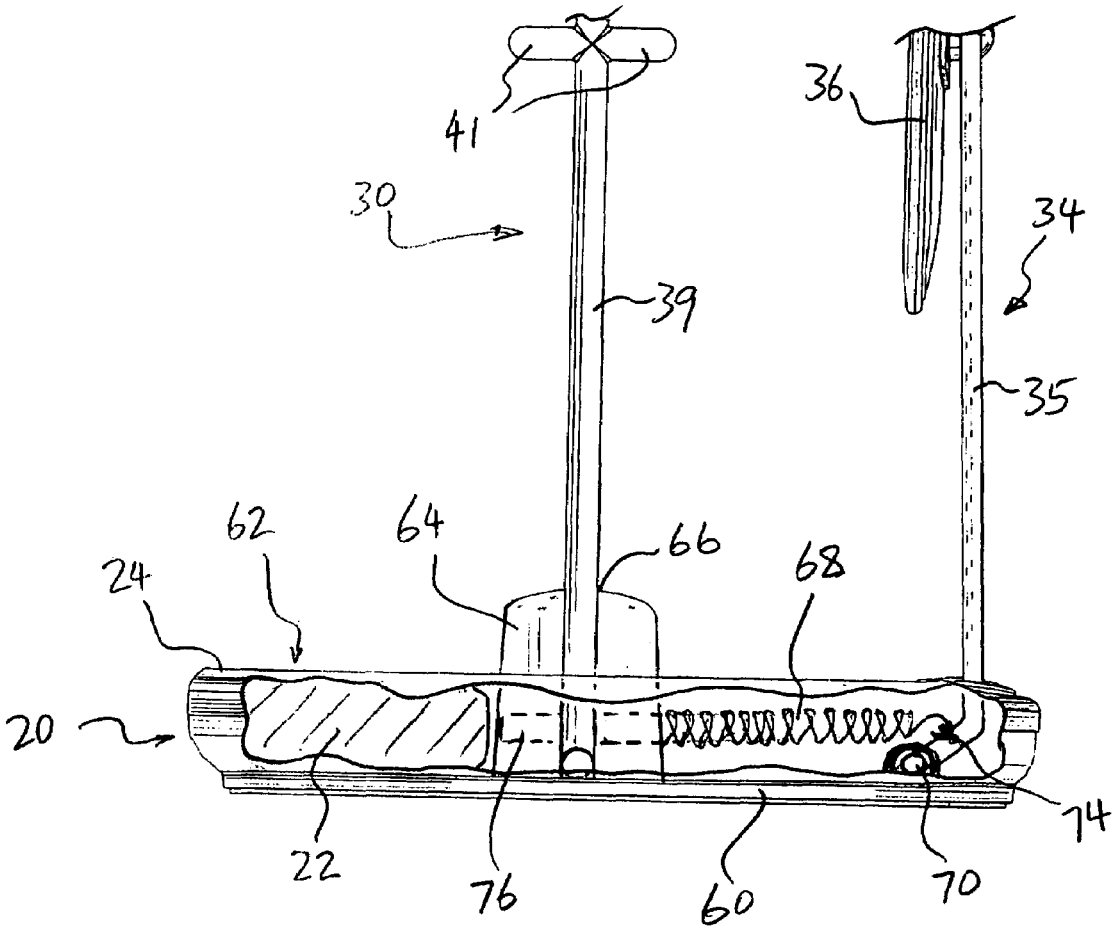
FIG. 5A is a side view of the paper towel holder of FIG. 1.
Figure 5B:
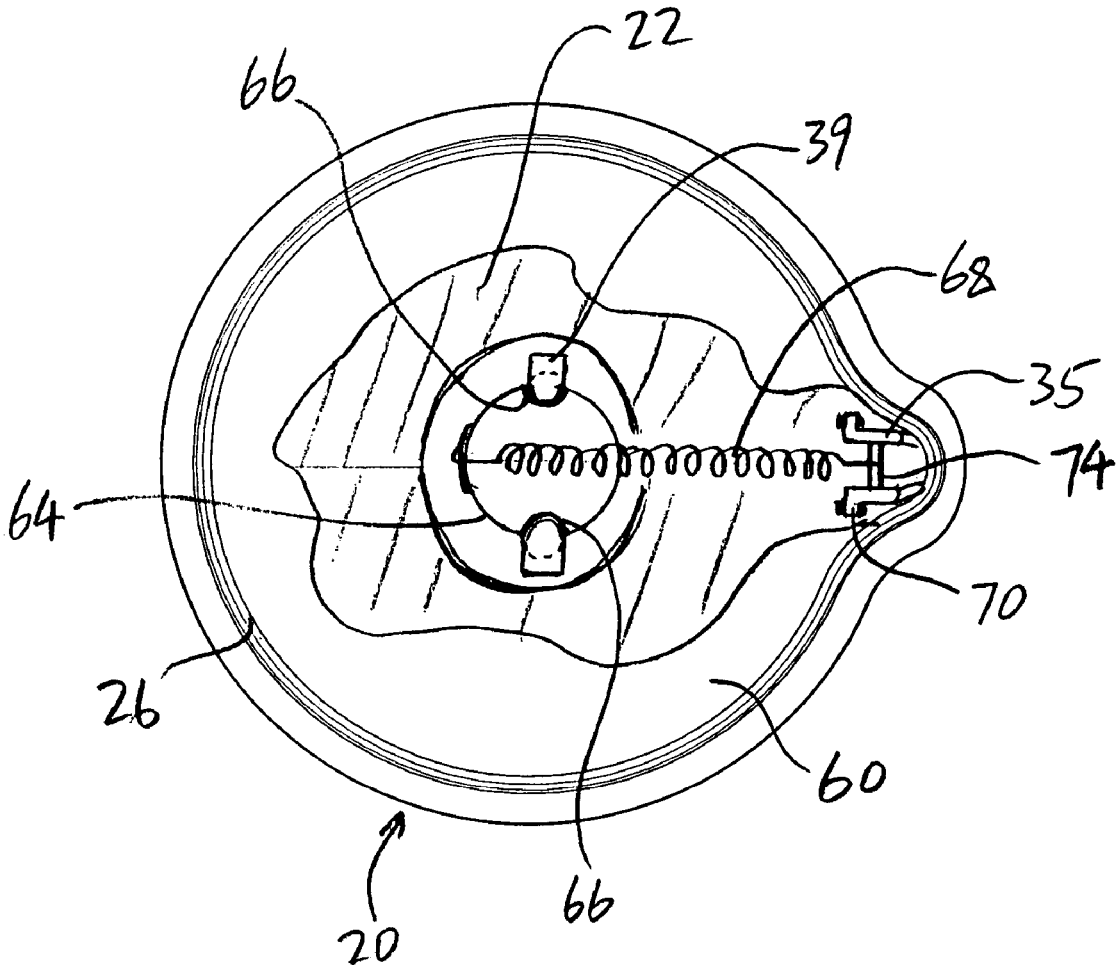
FIG. 5B is a bottom view of the paper towel holder of FIG. 1, both partially exposing the components in the base, in accordance with one embodiment of the present invention.

FIG. 5A and FIG. 5B illustrate an embodiment of the spring biased pivot of the arm 34 that supports the pad 36. The base 20 has a housing comprising a bottom 60 and a cover 62. The bottom 60 has a generally cylindrical stub 64 cantilevered at the center, which supports the pole 30, as will be further explained later below. The stub 64 extends through a hole in the center of the cover. A coil spring 68 is hingedly anchored at one end 76 to the stub 64, and connected under tension to a cross bar 74. (see also FIG. 5B) near the bottom end 70 of the arm 34 of the pressure bar 38. The end 70 of the arm 34 is hingedly or pivotally attached to the bottom 60, which functions as a hinge and a fulcrum for the applied spring force. The tension in the spring 68 normally biases the arm 34 to pivot radially towards the pole 30, thereby pressing the pad 36 on the outside of the paper towel roll 60.

In accordance with another aspect of the present invention, the leverage of the spring force with respect to the hinge of the arm 34 is configured such that the pressure of the pad 36 in the radial direction towards the pole 30 increases as the pad 36 approaches closer to the pole 30. The arm 34 is biased by the spring bias in an axial direction towards the pole, and the spring bias is applied to a point on the pressure bar such that leverage of the spring bias about the hinge increases as the pressure bar pivots towards the pole. The spring bias is spring tension bias, and the spring tension decreases at a lower rate than the increase in the leverage. This can be more easily understood by referring to FIGS. 10 and 11.

Figure 10:
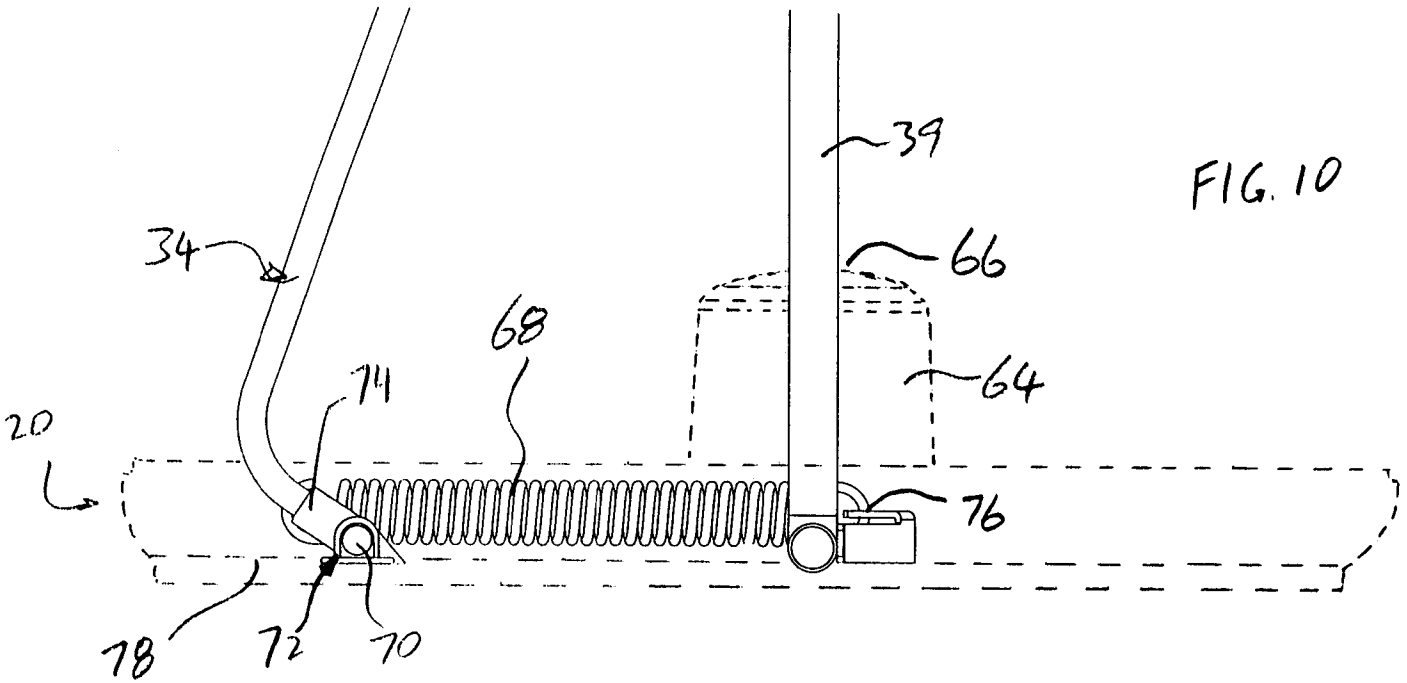
FIG. 10 is a schematic view of the spring and hinge at the base section of the paper towel holder.
Figure 11:
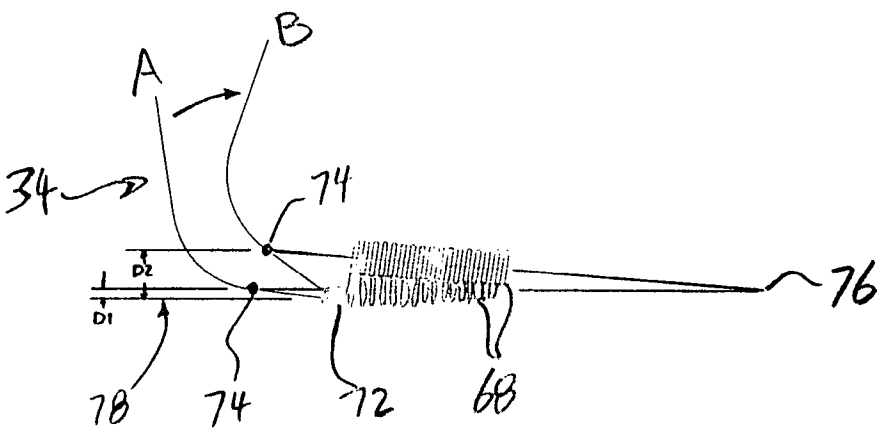
FIG. 11 is a schematic view showing the change in leverage of the spring force on the arm about the hinge.

FIG. 10 shows the configuration of the spring 68 and the hinge 72 at the base 20 of the towel holder (the base 20 is shown in phantom lines so as not to obscure the details of the spring and hinge components). FIG. 11 illustrates the change in leverage of the spring 68 as the arm 34 pivots in a direction towards the pole 39. When the arm 34 is in an outward extended position A, the axis of the spring 68 is at an angle about the hingedly anchor end 76, which is close to the horizontal plane 78 of the hinge 72. The cross bar 74 to which the spring 68 is attached is close to the horizontal plane 78, at a vertical distance DI. When the arm 34 is in an inward position B closer to the pole 39, the axis of the spring 68 is at an angle about the hingedly anchor end 76 which is further from the horizontal plane 78. At this position B, the cross bar 74 to which the spring 39 is attached is further from the horizontal plane 78, at a vertical distance D2. As can be seen in FIG. 11, distance D2 could be several times larger than distance DI. It is noted that as between position A and position B, the decrease in the extension of the spring 68 is relatively small, since the axis of the spring 68 pivots about the hingedly anchored end. Therefore, the decrease in the spring force on the cross bar 74 is small. Given that the distance D2 is significantly larger than distance DI, even with the decrease in spring force at position B, the leverage of the spring force at position B is larger than that at position A. Consequently, the pressure of the arm 34, and pad 36, towards the pole 30 increases as the arm 34 pivots towards the pole.

The base 20 includes also an appropriate weight 22 to provide adequate stability to the holder 10. The weight 22 can be any material (e.g., metal such as lead, iron, etc.) of sufficient weight to provide the holder 10 with a weighted base to hold the holder 10 in place when a user pulls on the roll 60 and tears off a piece of paper towel using one hand.

The cover 62, covers the weight 22 (which may be unfinished), to provide a finished structure for the base 20. The top surface of the cover 62 is provided with a raised lip 24 at the rim of the cover 62. The cover 62 may be made of plastic or metal, which may have a polished or textured finish. In the embodiment shown in FIG. 1, the cover 62 is made of stainless steel. A soft pad 26 may be provided below the bottom 60 (FIG. 5B), to provide a soft surface for resting the holder 10 on a support surface, such as a countertop. The pad 26 may comprise a material that prevents the base 20 from skidding on the support surface, and/or scratching the support surface.

In this embodiment, the base 20 takes on a flat circular configuration. It can be in other geometrical shapes, such as elliptical and polygonal shapes, without departing from the scope and spirit of the present invention.

In the illustrated embodiment, the pole 30 and the arm 34 comprise rod-shaped segments forming the outline of a frame structure. In particular, the arm 34 has a pair of longitudinal rod-shaped straight segments 35, which are spaced apart generally parallel and terminating in an integral bent at the end to which the pad 36 is attached. The bent conveniently provides for a pivot attachment to a hole in a stub 37 at the back of the pad 36 (see FIG. 3). Alternative or in addition to a frame structure, the pole 30 and/or arm 34 may take the form of a cylindrical, flat, solid, or hollow structure instead, without departing from the scope and spirit of the present invention. The rod-shaped frame segments may be of a desired thickness or gauge, such as about 0.25 inch. The rod-shaped segments may be of cylindrical sections having a cross-section of circular, square, rectangular, or other geometrical shapes.

Figure 4:
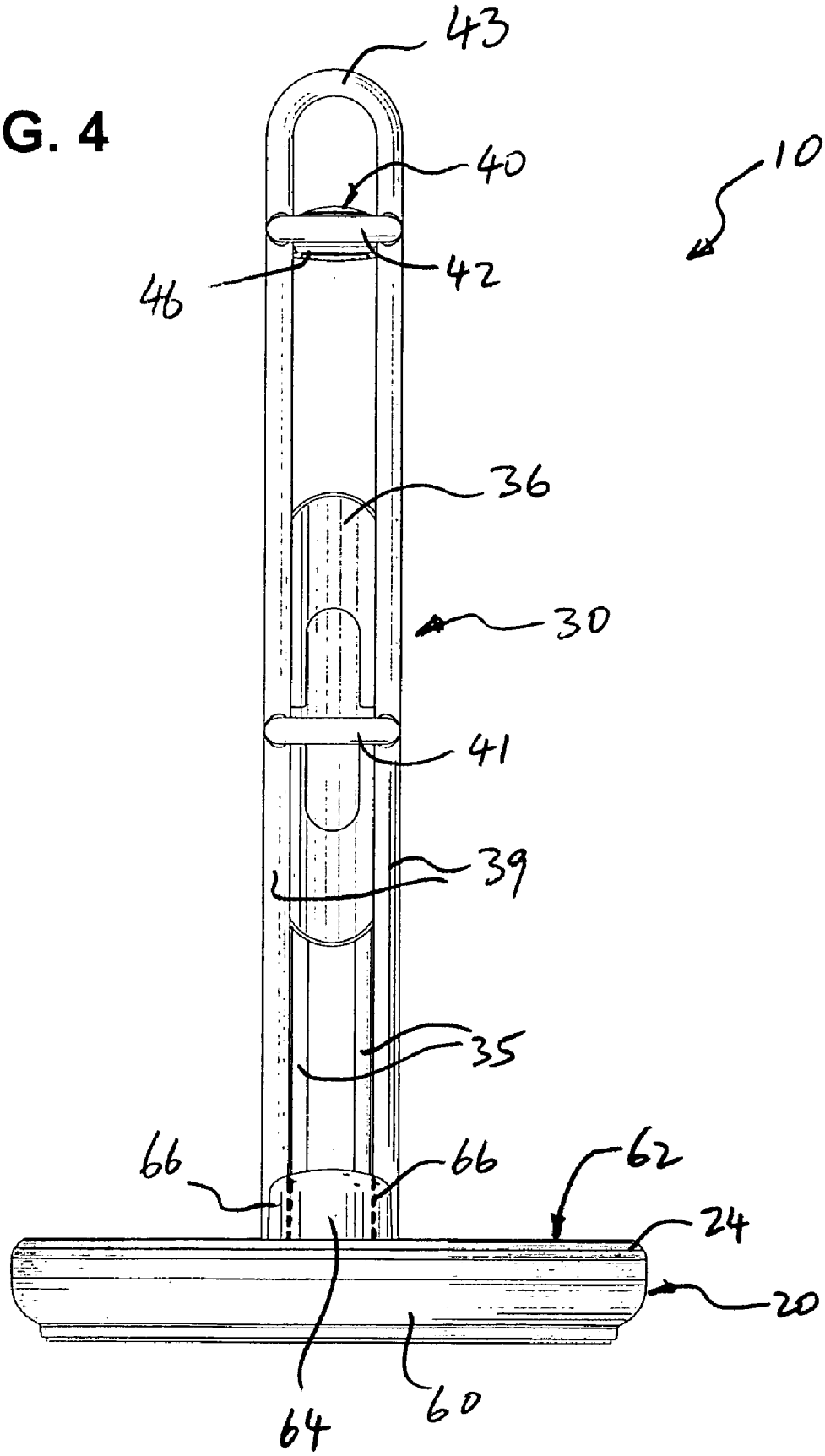
FIG. 4 is a front view of the embodiment of the paper towel holder of FIG. 1.

The rod-shaped frame structure of the pole 30 comprises a pair of vertical longitudinal straight segments 39 which are spaced apart generally in parallel. Referring to FIG. 5A, the vertical segments 39 are cantilever from the stub 64 in the base 20, by being held in grooves 66 in the stub 64 and anchored to the bottom 60. The vertical segments 39 are interconnected at their mid-sections by a pair of horizontal half-ring shaped segments 41. The segments 41 together form the outline of a circle, which is sized to be a little smaller in diameter than the inside diameter of the hollow core of the paper towel roll 60, so that the paper towel roll 60 can be received on the pole 30, with the segments 41 providing a structure that allow the paper towel roll to rotate about the pole 30 including the segments 41, but preventing excessive lateral free play between the core of the towel roll 60 and the pole 30. While only one pair of segments 41 is shown in the illustrated embodiment, additional similar segments may be provided along the longitudinal span of the vertical segments 39. For example, a half-ring shaped segment 42 (best seen in FIG. 3 and FIG. 4) is provided near the top of the pole 30.

The vertical segments 39 terminate in an integral bent 43 at the top end of the pole 30. The retaining tab 40 is pivotally supported near the bent 43. The retaining tab 40 is for securely retaining the paper towel roll from accidental detachment from the pole. The retaining tab 40 is pivoted to flip from a first orientation as shown in FIG. 1, in which the hollow core of the paper towel roll 60 is permitted to be received by the pole 30, to a second orientation as shown in FIG. 2 and FIG. 3, in which the paper towel roll is not permitted to be removed from the pole 30. Specifically in the illustrated embodiment, the retaining tab 40 is supported to pivot with respect to the pole 30, from an axial (or vertical) orientation (FIG. 1) to a radial (or horizontal) orientation (FIG. 2 and FIG. 3). In the illustrated embodiment, the retaining tab 40 has a portion 44 that has an external shape and size that fit within the bent 43 and a flange 46 that rest against the bent 43, when the retaining tab 40 is flipped to a vertical position, as shown in FIG. 1.

Figure 6:
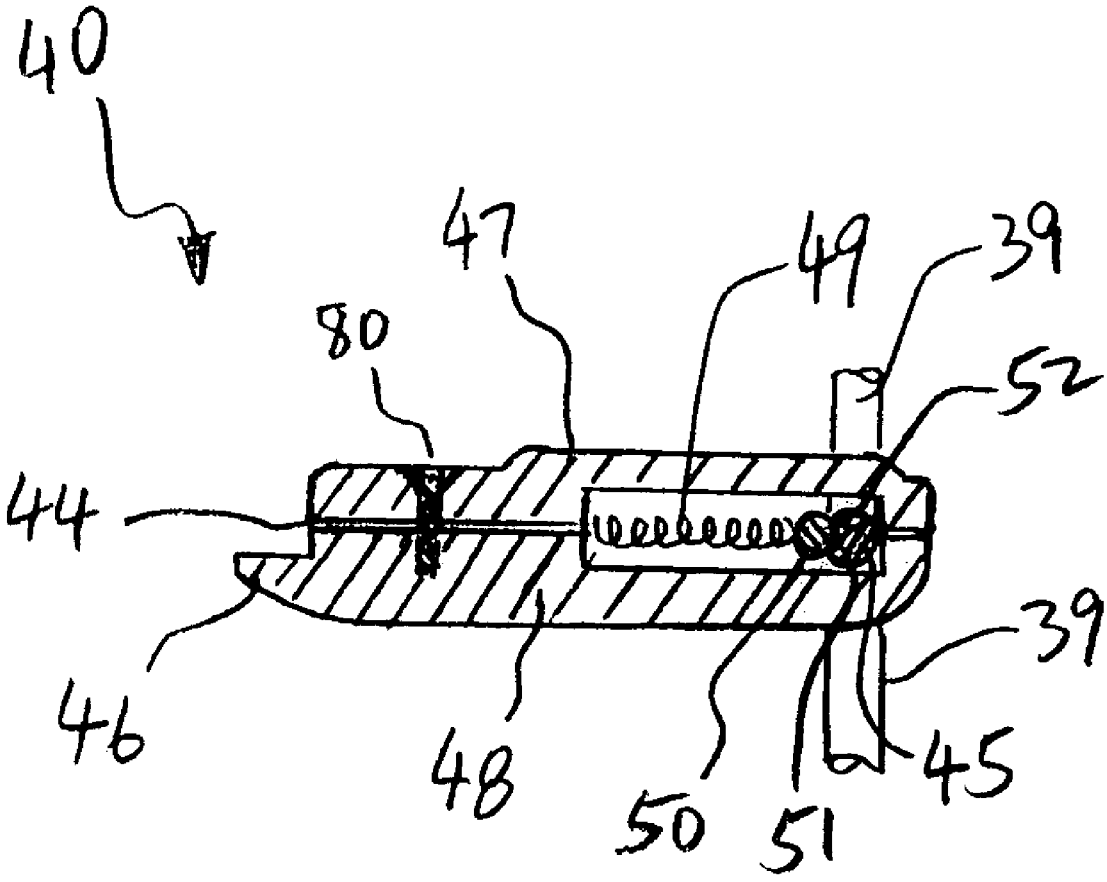
FIG. 6 is a sectional view of the retaining tab of the paper towel holder taken along line 6-6 in FIG. 2.

The retaining tab 40 pivots about a horizontal segment 45 provided across the vertical segments 39. FIG. 6 illustrates the pivot attachment of the retaining tab 40 to the segment 45. The segment 45 passes through the retaining tab 50, forming an axle about which the retaining tab 40 rotates. The retaining tab 40 includes two halves 47 and 48 held together by a fastener (e.g., screw 80), enclosing a coil spring 49 and a ball 50. The compressed coil spring 49 presses on the ball 50, which presses against the segment 45. An indent is provided on the side of the segment 45 and an indent 52 is provided on the top of the segment 45. When the retaining tab 40 is in the horizontal orientation as shown in FIG. 6, the spring 49 presses the ball 50 against the side indent 51, thereby providing resistance to hold the retaining tab 40 in its horizontal position against pivoting action. When the retaining tab 40 is in the vertical position as shown in FIG. 1, the spring 49 presses the ball against the top indent 52, thereby providing resistance to hold the retaining tab 40 in its vertical position against pivoting action. When it is required to flip the retaining tab 40 between such two positions, sufficient force must be applied to wedge the ball 52 out of the indent 51 or indent 52, against bias of the spring 49. Such force would be significantly larger than the force normally needed to pivot the retaining tab between the two indents, in order to overcome the initial force necessary to push the ball out of an indent against the compressive spring bias.

The various segments in the pole 30 may be made of metal (e.g., stainless steel or aluminum) and/or molded plastic, having a polished and/or textured surface finish. The body of the retaining tab 40 may comprise plastic and/or metal.

Variations of the free standing paper towel holder 10 may be. implemented without departing from the scope and spirit of the present invention. For example, the holder 10 may be adapted for mounting to a vertical surface, with the pole 30 in a vertical or horizontal orientation.

Figure 7:
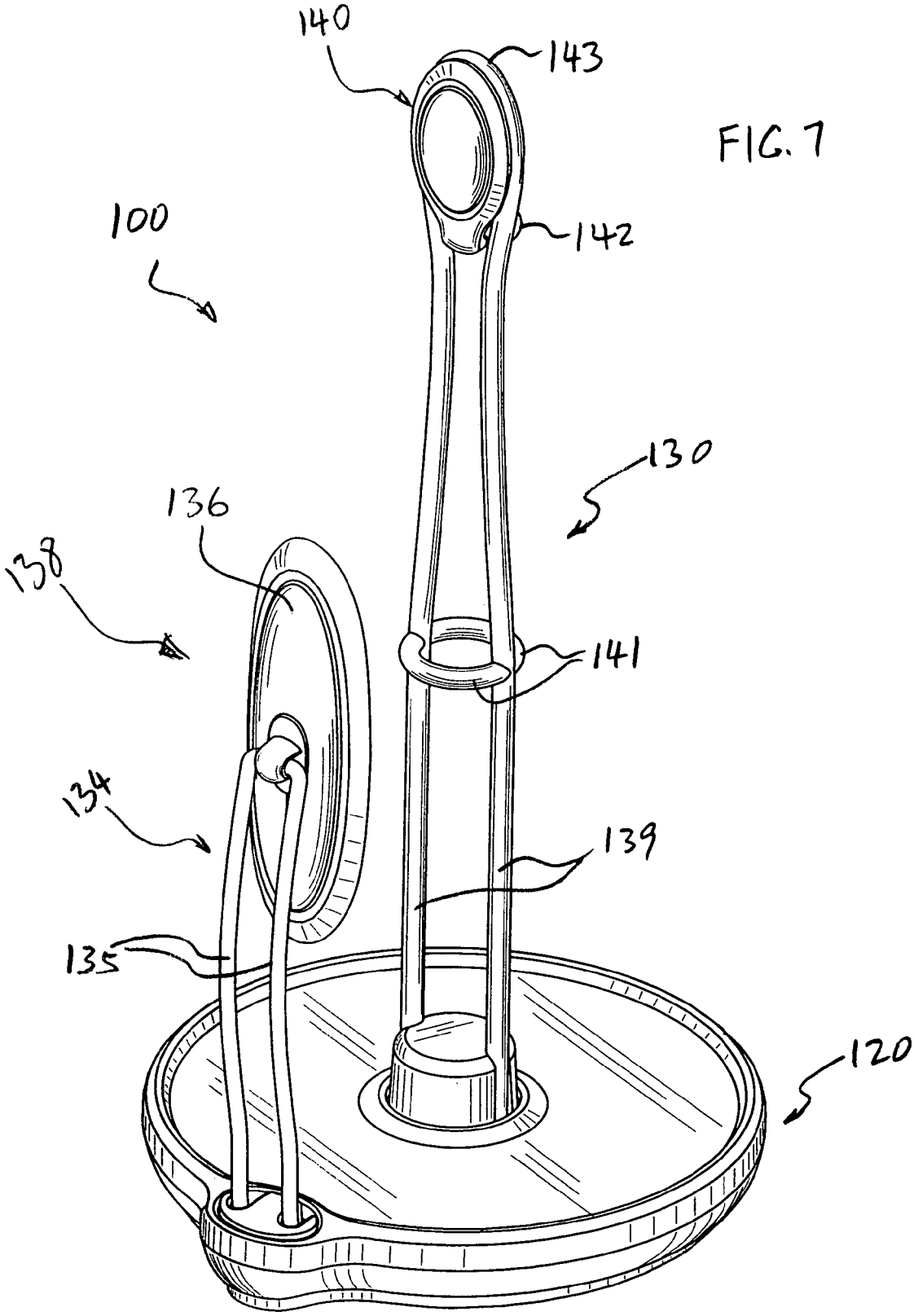
FIG. 7 is a perspective view of the paper towel holder in accordance with another embodiment of the present invention.
Figure 8:
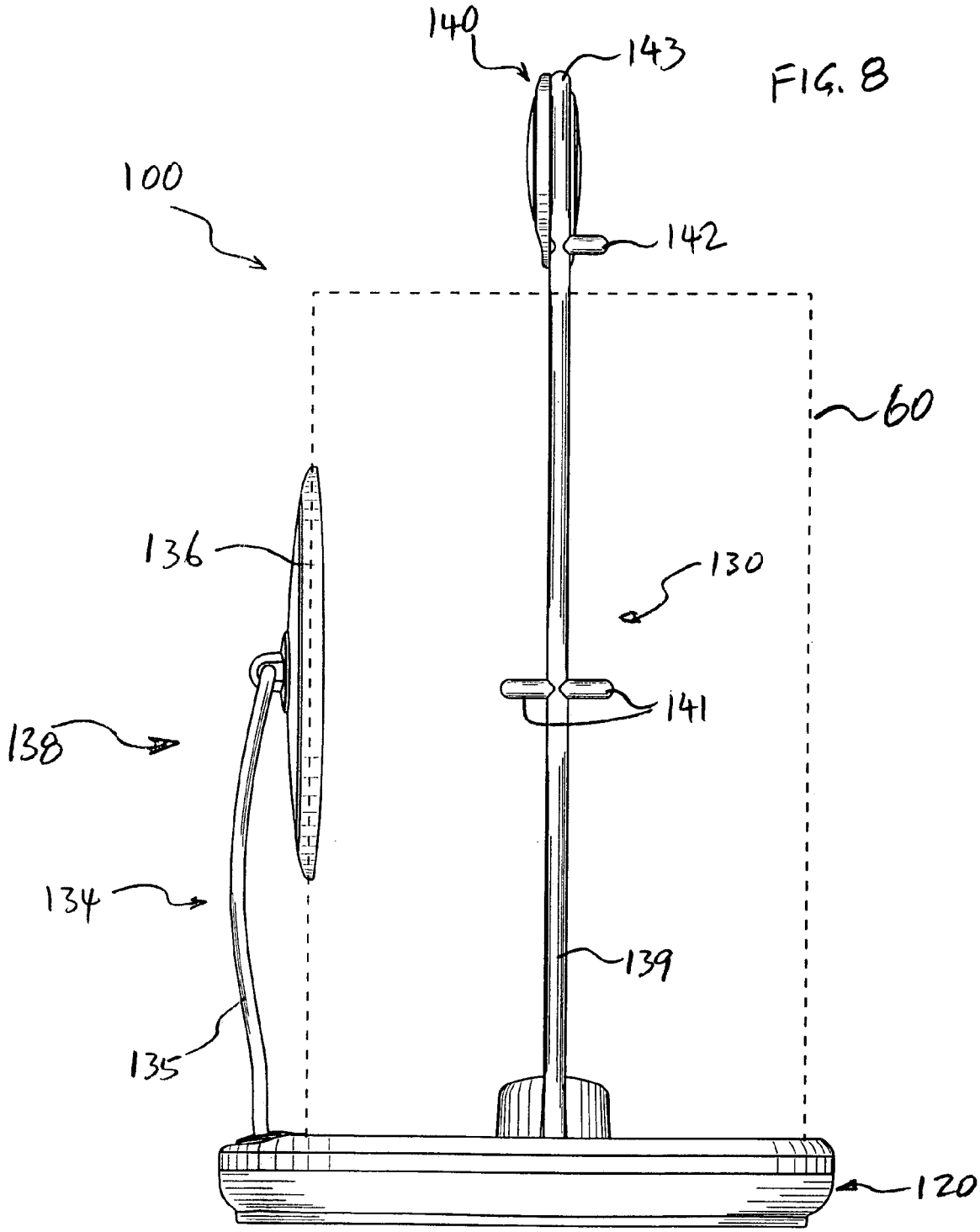
FIG. 8 is a side view of the embodiment of the paper towel holder of FIG. 7.
Figure 9:
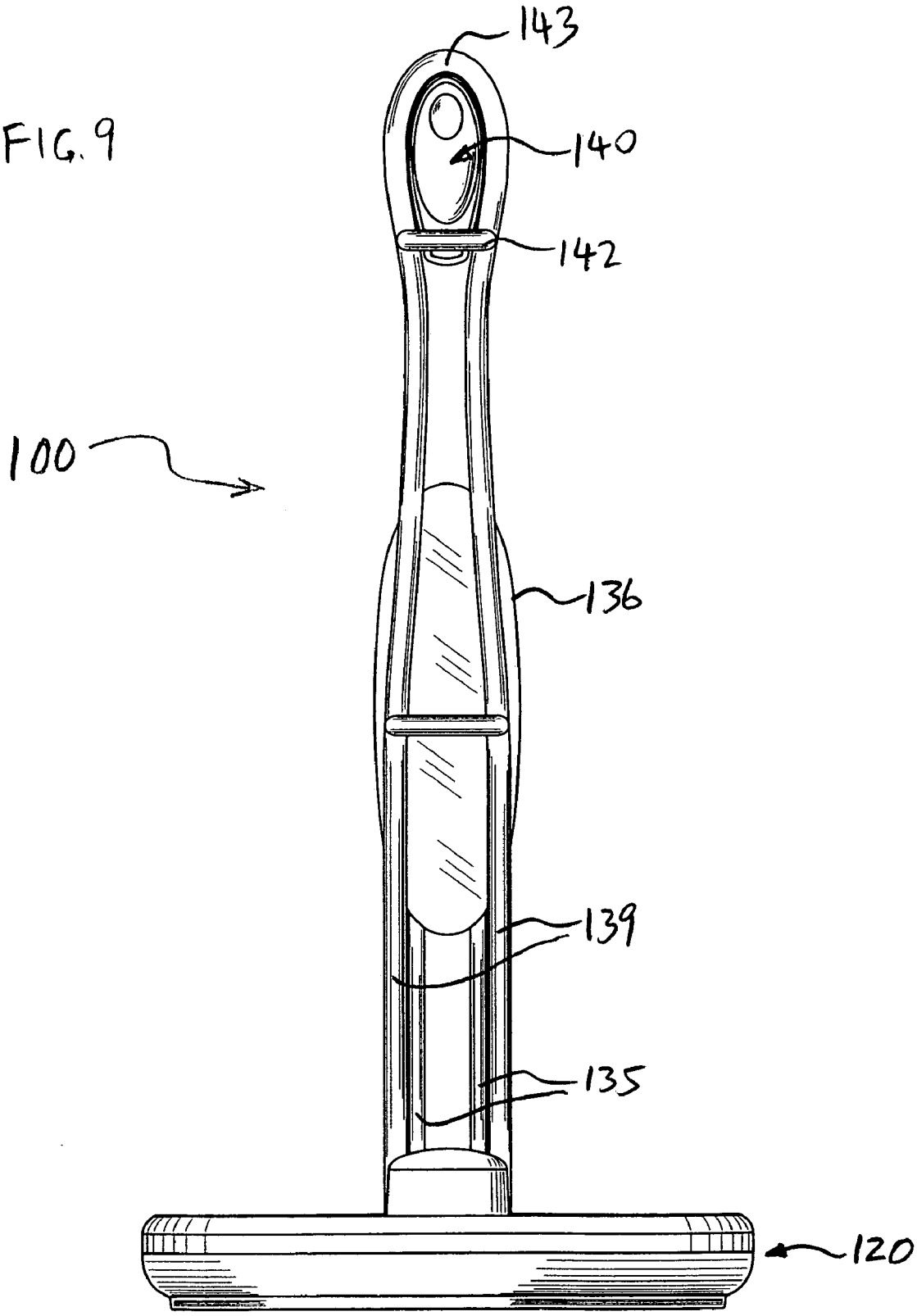
FIG. 9 is a front view of the embodiment of the paper towel holder of FIG. 7.

FIGS. 7 to 9 illustrate a paper towel holder in accordance with another embodiment of the present invention. In this embodiment, the paper towel holder 100 is generally similar to the paper towel holder 10 in the embodiment illustrated in FIG. 1, with the exception that the pole of the paper towel holder and the arm of the pressure bar are contoured.

Referring to FIGS. 7 to 9, the pole 130 includes a pair of generally parallel rod-shaped segments 139, which are bent towards each other starting from the mid-section (where a pair of half-ring segments 141 are present, as in the earlier embodiment), thereby creating an overall tapering contour for the pole 130, as in more clearly seen in FIG. 9. As in the previous embodiment, a retaining tab 140 is pivoted at the top end of the pole 130. The retaining tab 140 is shaped and sized to fit into an oval shaped space defined by the segments 139 and the bent 143, as more clearly shown in FIG. 9. A half-ring segment 142 is provided near the bent 143, as in the earlier embodiment. The pressure bar 138 includes an arm 135 that pivotally supports a pad 136, much like the earlier embodiment. The arm 135 includes a pair of parallel rod-shaped segments 135, which is provided with a slight S-shaped bent, in the radial plane, as is more clearly seen in FIG. 8. The other internal and external parts of the paper towel holder 100 are essentially similar or obvious variations to the corresponding parts described in connection with the embodiment of FIG. 1.

While the invention has been particularly shown and described with reference to the preferred embodiments, it will be understood by those skilled in the art that various changes in form and detail may be made without departing from the spirit, scope, and teaching of the invention. A person skilled in the art will recognize that the holder incorporating the essence of this invention can also be used for holding a roll of thin-ply sheets of other materials. Accordingly, the disclosed invention is to be considered merely as illustrative and limited in scope only as specified in the appended claims.

The invention claimed is:

1. A holder for a thin-ply roll, comprising:

a base;

a pole having one end attached to the base, and a distal end extending from the base; and a pressure bar pivotally attached to the base at a hinge, and is biased towards the pole, wherein the pressure bar presses against a thin-ply roll placed on the base, and wherein the bias is configured to increase as the pressure bar pivots towards the pole.

2. The holder as in claim 1, wherein the pressure bar is pivotally attached to a rim of the base.

3. The holder as in claim 2, wherein the pressure bar comprises an arm supporting a pad that has a contact surface facing the pole.

4. The holder as in claim 3, wherein the arm pivotally supports the pad.

5. The holder as in claim 1, wherein the pressure bar is biased by a spring bias in an axial direction towards the pole, and wherein the spring bias is applied to a point on the pressure bar such that leverage of the spring bias about the hinge increases as the pressure bar pivots towards the pole.

6. The holder as in claim 5, wherein the spring bias is a spring tension bias, and wherein the spring tension decreases at a lower rate than the increase in the leverage.

7. The holder as in claim 1, wherein the thin-ply roll comprises a paper towel roll.

8. The bolder as in claim 1, further comprising a retaining tab provided near the distal end of the pole.

9. The holder as in claim 8, wherein the retaining tab is pivotally attached near the distal end of the pole, wherein the tab can be pivoted from a first position in which the retaining tab extends generally radial with respect to the pole, and a second position in which the retaining tab extends axially with respect to the pole.

10. The holder as in claim 9, wherein a resistance is provided to hold the retaining tab at least at the first position to resist pivoting action.

11. The holder as in claim 1, wherein the bias is configured to increase as the pressure bar pivots closer towards the pole.

12. A holder for a thin-ply roll, comprising:

a base;

a pole having one end attached to the base, and a distal end extending from the base; and a retaining tab provided near the distal end of the pole, wherein the retaining tab is pivotally attached near the distal end of the pole, wherein the retaining tab can be pivoted from a first position in which the retaining tab extends generally radial with respect to the pole, and a second position in which the retaining tab extends axially with respect to the pole, and wherein a resistance is provided to hold the retaining tab at least at the second position to resist pivoting action, which spring bias is overcome to pivot the retaining tab from the second position to the first position.

13. The holder as in claim 12, wherein the resistance is provided to hold the retaining tab also at the first position to resist pivoting action.

14. The holder as in claim 13, wherein the resistance is provided by a spring bias.

15. The holder as in claim 14, wherein the spring bias is a compressive spring bias.

16. The holder as in claim 12, further comprising a pressure bar pivotally attached to the base, and is biased towards the pole, wherein the pressure bar presses against a thin-ply roll placed on the base.

17. The holder as in claim 16, wherein the pressure bar is pivotally attached to a rim of the base.

18. The holder as in claim 17, wherein the pressure bar is biased by a spring bias in an axial direction towards the pole.

19. The holder as in claim 12, wherein the pole comprises a frame structure having rod-shaped segments.

20. A holder for a thin-ply roll, comprising:

a base supporting the thin-ply roll;

a pole having one end attached to the base, and a distal end extending from the base;

a retaining tab provided near the distal end of the pole, wherein the retaining tab is positioned to block removal of the thin-ply roll, wherein the retaining tab is pivotally attached near the distal end of the pole, wherein the retaining tab can be pivoted from a first position in which the retaining tab extends generally radial with respect to the pole, and a second position in which the retaining tab extends axially with respect to the pole, and wherein a resistance is provided to hold the retaining tab at least at the second position to resist pivoting action, which spring bias is overcome to pivot the retaining tab from the second position to the first position; and a pressure bar pivotally attached to the base, and is biased towards the pole, wherein the pressure bar presses against the thin-ply roll placed on the base, and wherein the bias is configured to increase as the pressure bar pivots closer towards the pole.

* * * * *

UNITED STATES PATENT AND TRADEMARK OFFICE

CERTIFICATE OF CORRECTION

PATENT NO. : 7,559,504 B2
APPLICATION NO. : 11/698787
DATED : July 14, 2009
INVENTOR(S) : Yang et al.

It is certified that error appears in the above-identified patent and that said Letters Patent is hereby corrected as shown below:

Column 7, line 42, "bolder" should read --holder--.

Signed and Sealed this

Twenty-fourth Day of November, 2009

David J. Kappos

David J. Kappos
*Director of the United States Patent and Trademark Office*